US006462612B1

(12) United States Patent
Roh et al.

(10) Patent No.: US 6,462,612 B1
(45) Date of Patent: Oct. 8, 2002

(54) CHOPPER STABILIZED BANDGAP REFERENCE CIRCUIT TO CANCEL OFFSET VARIATION

(75) Inventors: Jeongjin Roh; Vijayakumaran V. Nair, both of Austin, TX (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 09/894,151

(22) Filed: Jun. 28, 2001

(51) Int. Cl.[7] ..... G05F 1/00
(52) U.S. Cl. ..... 327/539
(58) Field of Search ..... 327/530, 534, 327/538, 539, 541

(56) References Cited

U.S. PATENT DOCUMENTS 6,075,407 A * 6/2000 Doyle ..... 323/316
6,275,098 B1 * 8/2001 Uehara et al. ..... 323/313

OTHER PUBLICATIONS

Song, B., et al., "A Precision Curvature–Compensated CMOS Bandgap Reference", *IEEE J. Solid–State Circuits*, vol. SC–18, No. 6, pp. 634–643, (Dec., 1983).

* cited by examiner

*Primary Examiner*—Jeffrey Zweizig
(74) *Attorney, Agent, or Firm*—Schwegman, Lundberg, Woessner & Kluth P.A.

(57) ABSTRACT

A bandgap reference circuit utilizes chopper stabilization to reduce reference voltage variation caused by, for example, offset voltage and 1/f noise within an associated amplifier. The input signal of the amplifier is modulated using a high frequency modulation signal. The modulated signal is then amplified and demodulated. In one embodiment, a single-ended chopper amplifier having integrated amplification/demodulation functionality is provided.

27 Claims, 8 Drawing Sheets

| | CLK1=1 | CLK2=1 |
|---|---|---|
| CLKA | A1 | A2 |
| CLKB | A2 | A1 |

CHOPPER STABILIZED BANDGAP REFERENCE CIRCUIT TO CANCEL OFFSET VARIATION

FIELD OF THE INVENTION

The invention relates generally to electronic circuits and, more particularly, to voltage reference circuits.

BACKGROUND OF THE INVENTION

Integrated circuits, and other electronic circuits, often require operating voltages that are stable over process, voltage, and temperature variations. One type of circuit that is commonly used to provide stable voltages is the bandgap reference circuit. A bandgap reference circuit takes advantage of the unique characteristics of the bandgap energy of a semiconductor material (e.g., silicon) to provide a stable reference voltage. At a temperature of absolute zero (i.e., zero Kelvin), the bandgap energy of a semiconductor material is typically a physical constant. As the temperature of the semiconductor material rises from absolute zero, the bandgap energy of the material decreases (i.e., a negative temperature coefficient is displayed). The voltage across a forward biased PN junction (i.e., the junction between a positive (P) doped portion and a negative (N) doped portion of a semiconductor material) is an accurate indicator of the bandgap energy of a material. For this reason, the voltage across a forward biased PN junction will decrease as the temperature of the semiconductor material is raised. The rate at which the voltage decreases depends upon the junction (cross-sectional) area of the particular PN junction (as well as the semiconductor material being used). Therefore, the voltages across two forward biased PN junctions having different cross-sectional areas (but using the same semiconductor material) will vary at different rates with temperature, but each of these voltages can be traced back to the same bandgap voltage constant at absolute zero. The conventional bandgap reference circuit utilizes the voltage relationships between two forward biased PN junctions having different cross-sectional areas to achieve a relatively temperature insensitive output voltage.

In a conventional bandgap reference circuit, a feedback loop is used in conjunction with an operational amplifier to generate the reference voltage. The circuit basically operates as a feedback control loop to maintain the two input nodes of the operational amplifier at approximately the same potential in the steady state. A first input node (e.g., the non-inverting input node) of the operational amplifier is coupled to ground through a first PN junction (e.g., a diode or transistor). A second input node (e.g., the inverting input node) of the operational amplifier is coupled to ground through a resistor (R1) and a second PN junction that has a different cross-sectional area (typically larger) than the first PN junction. Substantially equal currents are forced through the first and second PN junctions during circuit operation. By carefully selecting circuit component values for the bandgap reference circuit, a system can be achieved that balances the negative temperature coefficient associated with one of the PN junctions with a positive temperature coefficient associated with the feedback loop to generate a relatively temperature insensitive output voltage.

Ideally, an operational amplifier will generate a zero output voltage when equal voltage levels are applied to the inverting and non-inverting inputs of the amplifier. In practice, however, a zero differential input voltage will generate a non-zero output He .voltage in an operational amplifier due to, among other things, asymmetries within the circuitry. For this reason, a small offset voltage ($V_{OS}$) is typically defined for an operational amplifier that will result in an output voltage of zero when a zero differential input voltage is applied to the amplifier. The offset voltage associated with a particular operational amplifier can vary with operating temperature and drift over time. As can be appreciated, these changes in the offset voltage can introduce error into a bandgap reference circuit using the operational amplifier. In addition, operational amplifiers also typically suffer from a noise component known as 1/f noise that increases with decreasing frequency. This form of noise can also introduce error into a bandgap reference circuit using the operational amplifier.

DETAILED DESCRIPTION

Figure 1:
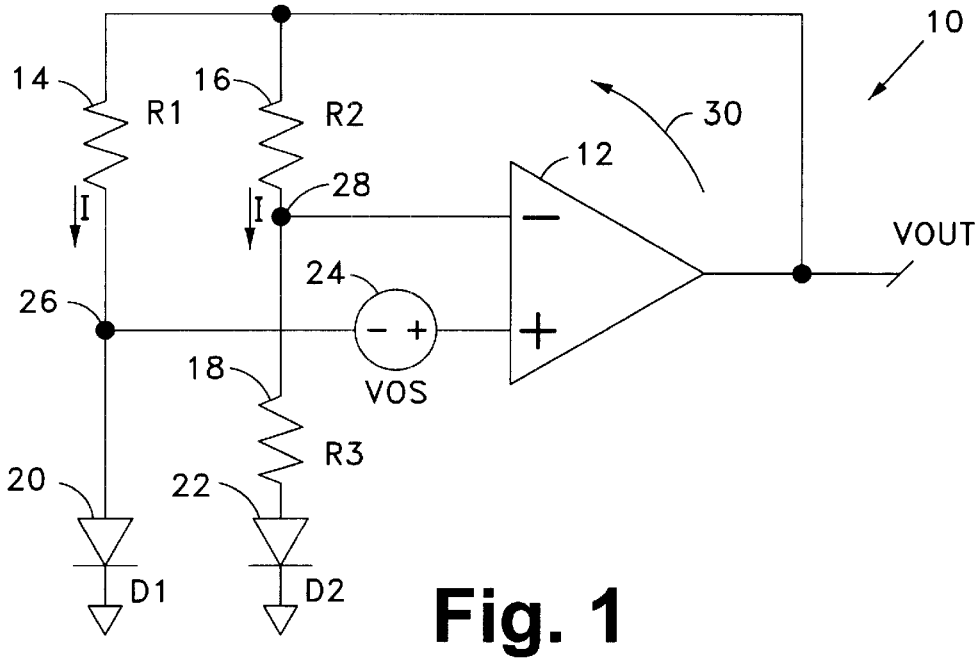
Fig. 1 (PRIOR ART)
FIG. 1 is a schematic diagram illustrating a conventional bandgap reference circuit.

In the following detailed description, reference is made to the accompanying drawings that show, by way of illustration, specific embodiments in which the invention may be practiced. These embodiments are described in sufficient detail to enable those skilled in the art to practice the invention. It is to be understood that the various embodiments of the invention, although different, are not necessarily mutually exclusive. For example, a particular feature, structure, or characteristic described herein in connection with one embodiment may be implemented within other embodiments without departing from the spirit and scope of the invention. In addition, it is to be understood that the location or arrangement of individual elements within each disclosed embodiment may be modified without departing from the spirit and scope of the invention. The following detailed description is, therefore, not to be taken in a limiting sense, and the scope of the present invention is defined only by the appended claims, appropriately interpreted, along with the full range of equivalents to which the claims are entitled. In the drawings, like numerals refer to the same or similar functionality throughout the several views.

The present invention relates to structures and techniques for generating a stable bandgap reference voltage. In one aspect of the invention, chopper stabilization is used to reduce the negative effects of offset voltage variation and/or 1/f noise within an amplifier in a bandgap reference circuit. The input signal of the amplifier is modulated using a high frequency modulation signal before the offset voltage and/or 1/f noise associated with the amplifier has acted upon the signal. The modulated input signal is then amplified and demodulated. The demodulation process returns the originally modulated input signal component of the amplified signal to a baseband representation. However, because the offset voltage and/or 1/f noise components of the amplified signal were not originally modulated, the demodulation process modulates these noise components to a higher frequency. These high frequency noise components are then filtered out (e.g., using a low pass filter) to achieve a desired output signal. In one embodiment of the invention, the low pass filter functionality of a chopper stabilized bandgap reference system is implemented outside of the feedback loop of the amplifier to provide enhanced circuit stability and to allow higher operational speeds to be achieved in the bandgap reference circuit.

In another aspect of the invention, a single-ended chopper amplifier architecture is provided that is relatively simple and inexpensive to design and implement. By generating a single ended output, the architecture eliminates the need for a common-mode feedback (CMFB) circuit at the amplifier output. Because CMFB circuits are typically difficult to design and normally consume a relatively large area on a semiconductor chip, the elimination of such a circuit can result in significant cost and/or time savings. In at least one embodiment, the single-ended chopper amplifier architecture incorporates the demodulation functionality required for chopper stabilization into the output stage of the operational amplifier. The inventive chopper amplifier architecture can be used within bandgap reference circuits, as discussed above, and in a variety of other applications implementing chopper stabilization.

FIG. 1 is a schematic diagram illustrating a conventional bandgap reference circuit 10. As shown, the bandgap reference circuit 10 includes: an operational amplifier 12; first, second, and third resistors ($R_1$, $R_2$, $R_3$) 14, 16, 18; first and second diodes ($D_1$, $D_2$) 20, 22; and an offset voltage 24. The first and second diodes 20, 22 are semiconductor structures that each include a PN junction. As will be appreciated, semiconductor devices other than diodes that include a PN junction may alternatively be used within the circuit 10. The second diode 22 has a cross-sectional area that is significantly larger than that of the first diode 20. In one embodiment, for example, the cross-sectional area of the second diode 22 is approximately eight times that of the first diode 20 (i.e., n=8). The second diode 22 may include a single diode having large dimensions or, alternatively, the second diode 22 may consist of a number of smaller devices connected in parallel to achieve a high effective cross-sectional area. In one embodiment, for example, the second diode 22 consists of eight diodes connected in parallel that are each substantially the same size as the first diode 20. Many other arrangements are also possible.

The first diode 20 is connected between a first input node 26 and ground. The third resistor 18 and the second diode 22 are connected in series between a second input node 28 and ground. The offset voltage ($V_{OS}$) 24 is added to the input signal that exists between the two input nodes 26, 28. A feedback loop 30 is provided to feed back a portion of the output signal $V_{OUT}$ to the inputs of the operational amplifier 12. The output signal is fed back to the first input node 26 through the first resistor 14 and to the second input node 28 through the second resistor 16. The first and second resistors ($R_1$, $R_2$) 14, 16 preferably have equal resistance values.

As described previously, the conventional bandgap reference circuit 10 operates, to a large extent, as a feedback control loop that maintains the first and second input nodes 26, 28 at approximately the same potential in the steady state. Thus, the current through the first resistor 14 and the current through the second resistor 16 (as well as the currents through the first and second diodes 20, 22) will be substantially the same. By analyzing the loop equations for the bandgap reference circuit 10, the following relationship is derived for the reference voltage $V_{OUT}$ of the circuit:

$$V_{OUT}=V_{D2}+(1+R_2/R_3)*(V_t*\ln(n)+V_{OS})$$

where $VD_2$ is the voltage across the second diode 22, $V_t$ is the thermal voltage (which is equal to approximately 25.875 millivolts at room temperature), n is the ratio between the cross sectional area of the second diode 22 with respect to the first diode 20, and $V_{OS}$ is the offset voltage. As is apparent from the above equation, the offset voltage of the operational amplifier will be amplified by $(1+R_2/R_3)$ in the conventional bandgap reference circuit 10 of FIG. 1. Ideally, the output reference voltage of the circuit 10 will be relatively stable with time and temperature. However, as shown above, variations in the offset voltage $V_{OS}$ of the operational amplifier 12 will introduce errors into the reference voltage that may be intolerable.

Figure 2:
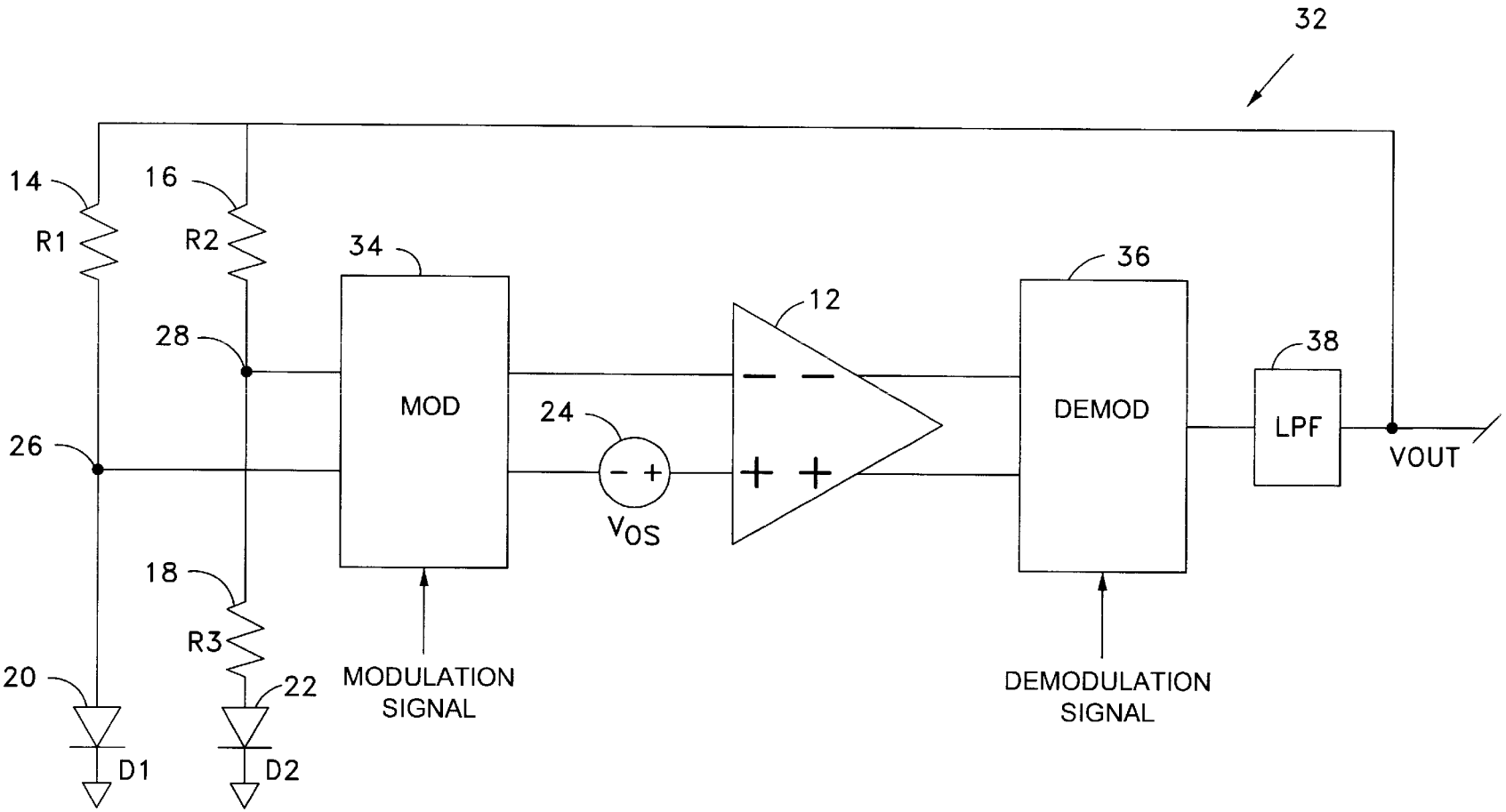
FIG. 2 is a schematic diagram illustrating a chopper stabilized bandgap reference circuit in accordance with an embodiment of the present invention.

FIG. 2 is a schematic diagram illustrating a chopper stabilized bandgap reference circuit 32 in accordance with an embodiment of the present invention. The chopper stabilized bandgap reference circuit 32 is similar to the conventional bandgap reference circuit illustrated in FIG. 1, except for the addition of a modulator 34 at the input of the operational amplifier 12, a demodulator 36 at the output of the operational amplifier 12, and a low pass filter (LPF) 38 at the output of the demodulator 36. The modulator 34 is operative for modulating the voltage signal between the first and second input nodes 26, 28 of the circuit using a high frequency modulation signal. In one approach, a square wave having a relatively high repetition frequency (e.g., 0.1 megaHertz in one implementation) is used as the modulation signal. As will be appreciated, other modulation signal types (e.g., sinusoidal signals, etc.) may alternatively be used. In effect, the modulator 34 acts to translate the slowly varying input signal to a higher frequency region within the signal spectrum (e.g., to the center frequency of the modulation signal). The output signal of the modulator 34 is applied to the input of the operational amplifier 12 as described previously. The offset voltage $V_{OS}$ is added to the input signal after modulation has occurred and thus remains unmodulated. The input signal is then processed by the operational amplifier 12 to generate an amplified signal at an output thereof.

The output signal of the operational amplifier 12 is delivered to the demodulator 36 which demodulates the signal using a high frequency demodulation signal. Typically, the demodulation signal will be synchronized with the modulation signal and have the same or a similar wave shape (e.g., square wave, etc.). In at least one embodiment, the same signal (or signals) are used for both modulation and demodulation. Portions of the output signal of the operational amplifier 12 that had previously been modulated within the modulator 34 are demodulated by the demodulator 36 to a baseband representation. Portions of the output signal that had not been previously modulated in the modulator 34 (e.g., components resulting from the offset voltage and 1/f noise) are translated up in frequency by the demodulator 36 (i.e., they are modulated), thus generating high frequency noise components at the output of the demodulator 36. The LPF 38 filters out these (and possibly other) high frequency noise components to reduce the level of noise within the output reference voltage $V_{OUT}$. In this manner, the offset voltage $V_{OS}$ and the 1/f noise have less impact on the output reference voltage $V_{OUT}$ generated by the circuit 32.

Figure 5:
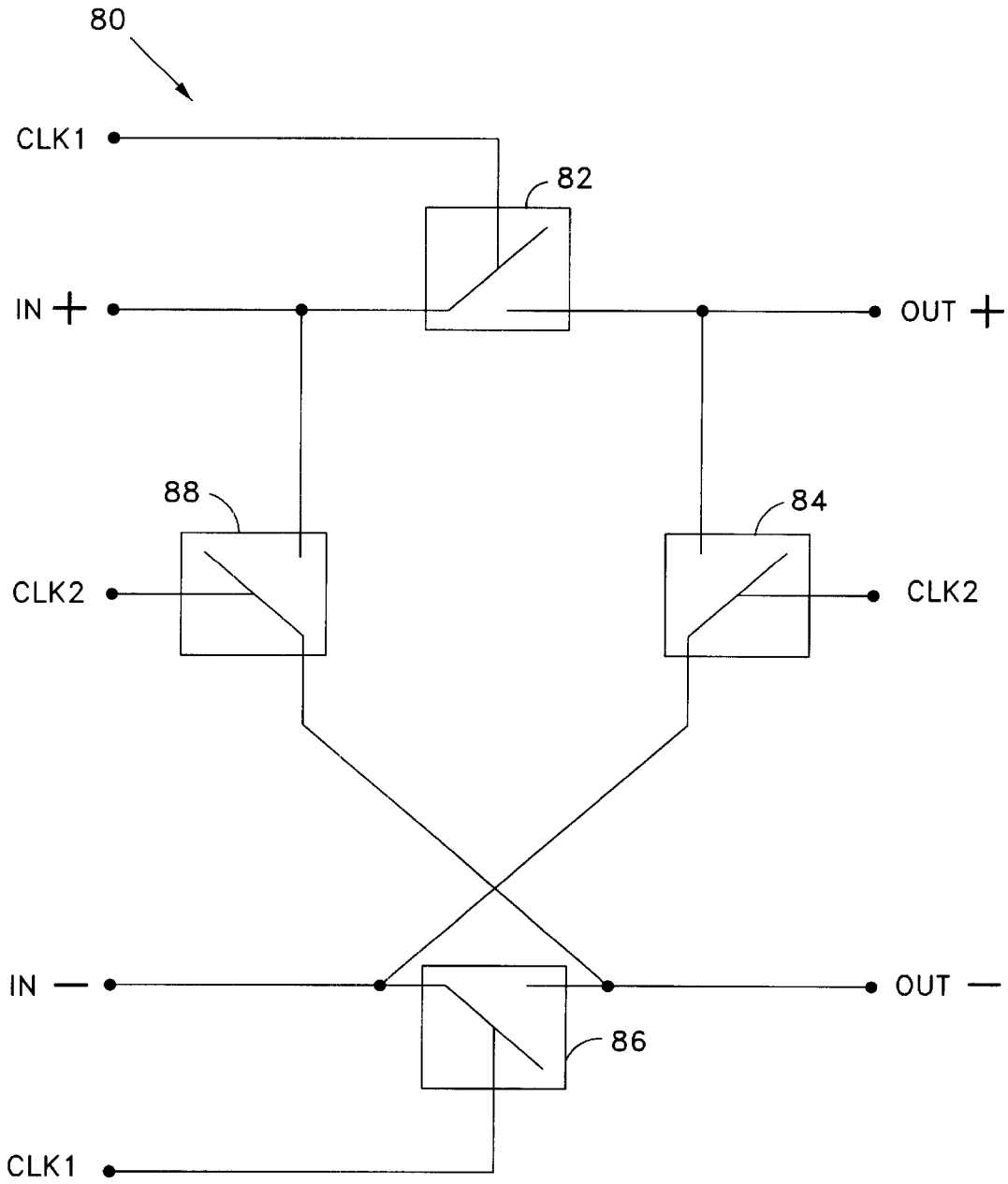
FIG. 5 is a schematic diagram illustrating a multiplier circuit that is used as a modulator in at least one embodiment of the present invention.

In at least one embodiment, the modulator 34 of the bandgap reference circuit 32 includes a multiplier circuit for multiplying the differential input signal by the modulation signal. FIG. 5 is a schematic diagram illustrating one such multiplier circuit 80. As shown, the multiplier circuit 80 includes four complementary metal oxide semiconductor (CMOS) switches 82, 84, 86, 88 that are controlled by two input clock signals (CLK1, CLK2) that act in concert as the modulation signal. In this manner, an input signal applied to the differential input terminals (IN+, IN−) of the multiplier circuit 80 is multiplied by the modulation signal to generate a high frequency modulated output signal at the differential output terminals (OUT+, OUT−). A similar multiplier circuit may also be used as the demodulator 36 of the bandgap reference circuit 32.

Referring back to FIG. 2, the LPF 38 will typically present an additional output load to the operational amplifier 12. That is, the LPF 38 will typically add at least one low frequency pole to the transfer function of the circuitry. The presence of this additional low frequency pole (or poles) may make the design of a stable chopper amplifier more difficult. In addition, the low frequency pole(s) may also decrease the unity-gain bandwidth of the chopper amplifier and thus make it more difficult to achieve adequate gain at the desired operating frequency of the amplifier (i.e., the frequency of the modulation signal). Therefore, in at least one embodiment of the a present invention, a bandgap reference circuit using chopper stabilization is provided that implements the LPF outside of the closed feedback loop of the operational amplifier. By implementing the LPF outside of the closed feedback loop, little or no additional load is placed upon the operational amplifier 12 and the problems associated with additional low frequency poles are avoided. Thus, the benefits of chopper stabilization are achieved without affecting the unity-gain bandwidth or stability of the amplifier.

Figure 3:
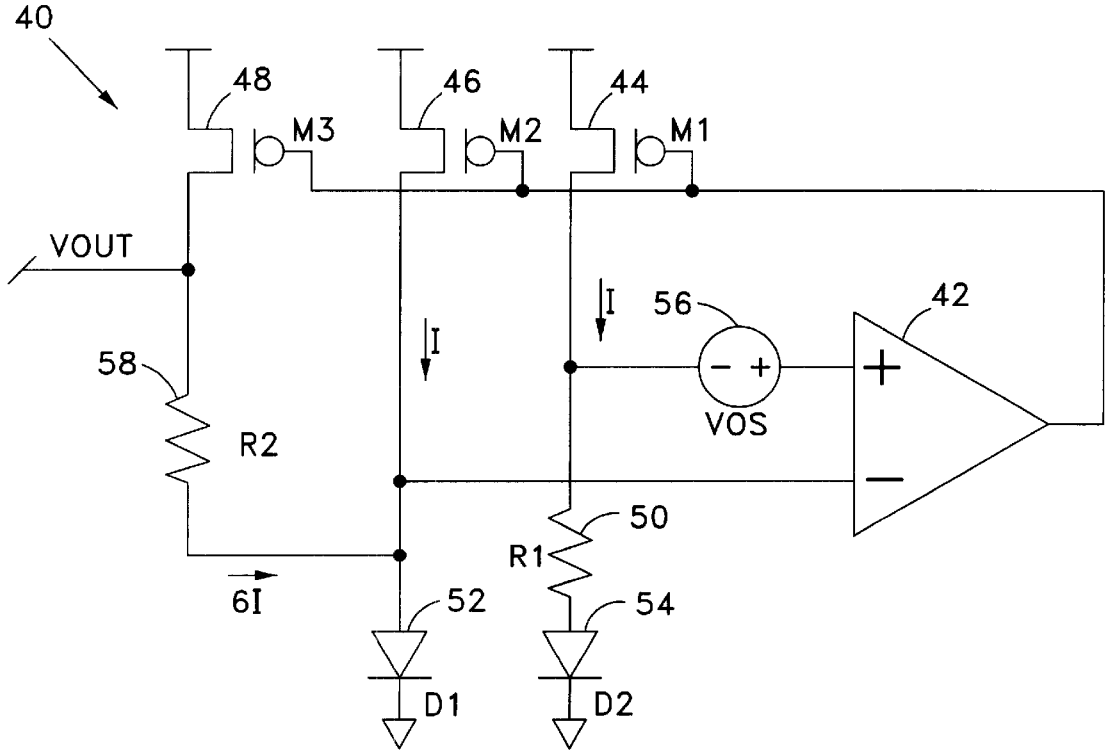
Fig. 3 (PRIOR ART)
FIG. 3 is a schematic diagram illustrating another bandgap reference circuit that can be modified in accordance with the present invention.

FIG. 3 is a schematic diagram illustrating a bandgap reference circuit 40 that can be modified in accordance with the present invention to include chopper stabilization functionality. As illustrated, the bandgap reference circuit 40 includes: an operational amplifier 42; first, second, and third transistors ($M_1$, $M_2$, $M_3$) 44, 46, 48; first and second resistors ($R_1$, $R_2$) 50, 58; first and second diodes ($D_1$, $D_2$) 52, 54; and an offset voltage 56. As before, the cross-sectional area of the second diode 54 is larger than the cross-sectional area of the first diode 52 by a predetermined ratio. In the illustrated embodiment, the first, second, and third transistors 44,46,48 are p-channel metal oxide semiconductor (PMOS) transistors, although other transistor types may alternatively be used. The gate terminals of the first, second, and third transistors 44,46,48 are each connected to the output of the operational amplifier 42. The first and second transistors 44, 46 are substantially the same size and form a current mirror within the bandgap reference circuit 40. Thus, the currents through the first and second diodes 52, 54 are substantially equal during normal operation.

The third transistor 48 is part of a third branch of the bandgap reference circuit 40 that is located outside of the feedback loop of the operational amplifier 42. The third transistor 48 has a larger cross-sectional area than the other two transistors and thus forms a ratioed current mirror with these devices. In one embodiment, the cross-sectional area of the third transistor 48 is six times that of the first and second transistors 44, 46 and thus forms a current mirror ratio of 6:1:1 within the bandgap reference circuit 40. As shown, the reference voltage $V_{OUT}$ of the bandgap reference circuit 40 is developed within the third branch of the circuit and is thus outside the feedback loop. By analyzing the loop equations for the bandgap reference circuit 40, the following relationship is derived for the reference voltage $V_{OUT}$ of the circuit:

$$V_{OUT}=6(V_t * ln(56)+V_{OS}) * R_2/R_1+V_{D1}$$

where $V_t$ is the thermal voltage, $V_{OS}$ is the offset voltage, and $V_{D1}$ is the voltage across the first diode 52. This equation assumes a current mirror ratio of 6:1:1 and a cross-sectional area ratio of 1:8 between the first and second diodes 52, 54. The bandgap reference circuit 40 of FIG. 3 is described in greater detail in U.S. Pat. No. 6,075,407.

Figure 4:
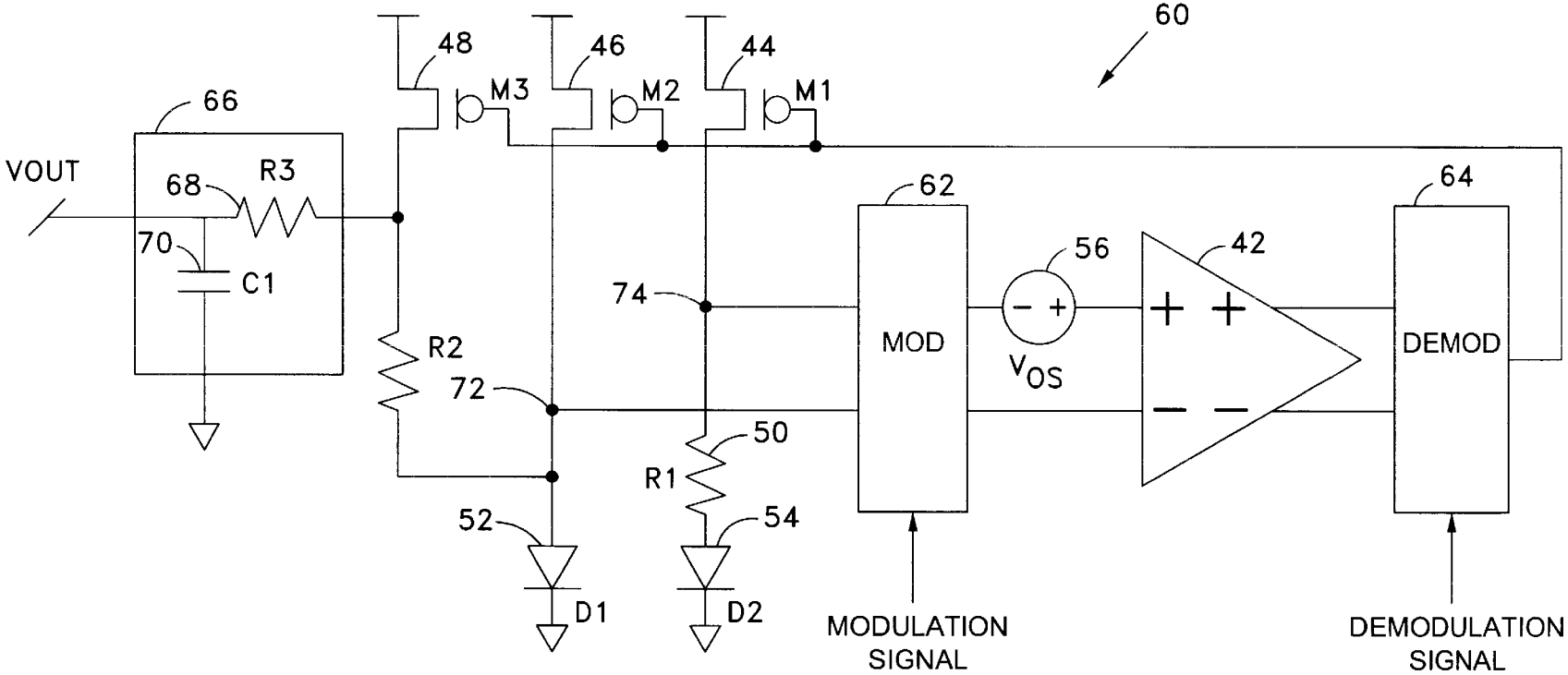
FIG. 4 is a schematic diagram illustrating the bandgap reference circuit of FIG. 3 modified to include chopper stabilization in accordance with another embodiment of the present invention.

FIG. 4 is a schematic diagram illustrating a chopper stabilized bandgap reference circuit 60 in accordance with another embodiment of the present invention. The bandgap reference circuit 60 of FIG. 4 is similar to the circuit 40 of FIG. 3, except for the addition of a modulator 62, a demodulator 64, and a low pass filter 66. The operation of the modulator 62 and the demodulator 64 is substantially the same as discussed previously in connection with the bandgap reference circuit 32 of FIG. 2. That is, the modulator 62 modulates a voltage signal between two input nodes 72, 74 before the offset voltage 56 is added to the signal. The demodulator 64 then demodulates the output signal of the operational amplifier 42 which translates a desired (modulated) portion of the output signal to a baseband representation while translating an undesired (unmodulated) portion of the output signal to the modulation frequency.

As in the circuit of FIG. 2, the LPF 66 is used to filter out high frequency noise components output by the demodulator 64. However, unlike the previous embodiment, the LPF 66 is located outside the feedback loop of the operational amplifier 42. Thus, the LPF 66 provides little additional loading on the operational amplifier 42 and does not significantly effect the stability or gain-bandwidth product of the amplifier. In the illustrated embodiment, the LPF 66 is a first order RC filter structure having a single resistor 68 and single capacitor 70. It should be appreciated that other low pass filter arrangements can alternatively be used, including more complex structures and/or higher order structures. Because the LPF 66 is isolated from the operational amplifier 42, the chopper amplifier's speed and stability will be relatively independent of the choice of element values and/or architecture for the LPF 66. With reference to FIG. 4, the capacitor 70 will typically have a relatively large capacitance value (e.g., from several hundred nanoFarads to several microFarads) to achieve a sufficiently low cutoff frequency for the LPF 66. Accordingly, one further advantage of the circuit architecture of FIG. 4 is that this large capacitor is more easily implemented as an off-chip capacitor because it is not part of the feedback loop.

Simulations have shown significant reductions in reference voltage variation over a conventional bandgap reference circuit using the circuit architecture of FIG. 4. For a simulated offset voltage of 6 millivolts (mV), for example, the circuit 60 produced a reference voltage variation of 0.22 mV as opposed to 34.2 mV of output voltage variation in the convention circuit. Similar improvements are seen at other offset voltage levels.

The above-described advantages may be achieved within any bandgap reference circuit design that develops the output reference voltage outside of the closed feedback loop of the operational amplifier. This is because the low pass filter used for chopper stabilization can be separated from the chopper amplifier and thus have reduced impact on the operation thereof. In one approach, as discussed above, the output voltage is developed within a third circuit branch that is outside the closed feedback loop. The low pass filter functionality is thus implemented as part of the third circuit branch. As will be apparent to a person of ordinary skill in the art, other circuit arrangements are also possible.

Figure 6:
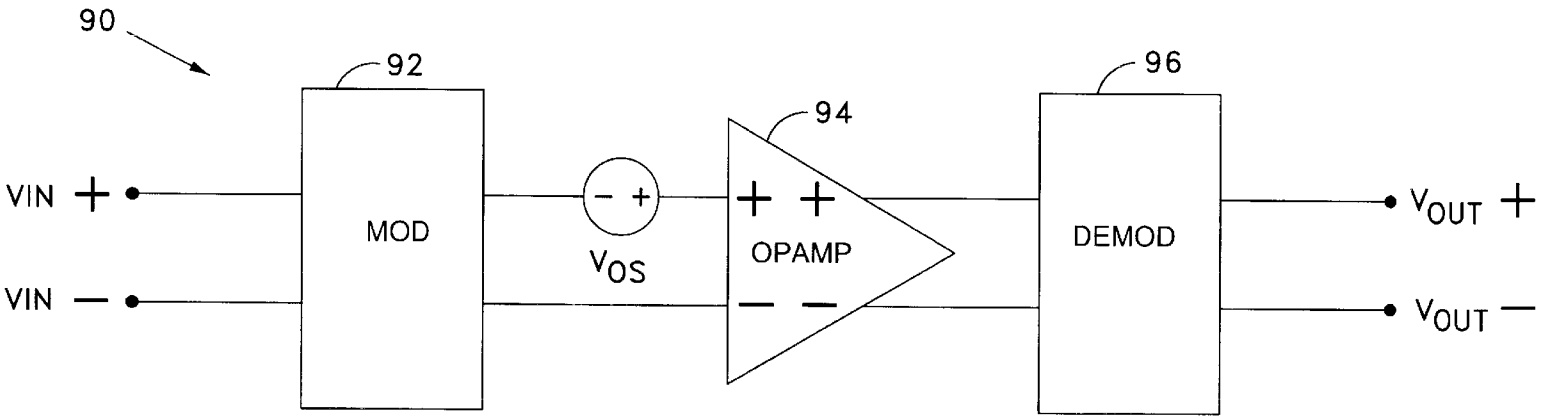
FIG. 6 is a block diagram illustrating a conventional fully differential chopper amplifier architecture.

Any of a number of different chopper amplifier architectures can be used to provide chopper stabilization within a bandgap reference circuit in accordance with the present invention. Traditionally, chopper amplifiers have been implemented using a fully differential approach. As illustrated in FIG. 6, one popular chopper amplifier design 90 includes a fully differential operational amplifier 94 having a separate differential input modulator 92 and a separate differential output demodulator 96. In conceiving the present invention, it was appreciated that the use of a fully differential amplifier architecture can sometimes be inefficient and unnecessarily expensive. For example, fully differential architectures typically require extra design effort and consume more surface area on a semiconductor chip than, for instance, single-ended architectures. Fully differential architectures also typically require the use of a common-mode feedback (CMFB) circuit at the output of the operational amplifier to control the common mode voltage level at the output. A CMFB circuit will usually detect the common mode signal level at the output of the amplifier and then use the detected level to control the internal bias voltage level of the fully differential amplifier. As can be appreciated, the design of a good CMFB circuit can be time consuming and the resulting circuit will typically consume a relatively large area on a semiconductor chip. Thus, in one aspect of the present invention, a single-ended chopper amplifier architecture is provided that does not require a CMFB circuit.

Figure 7:
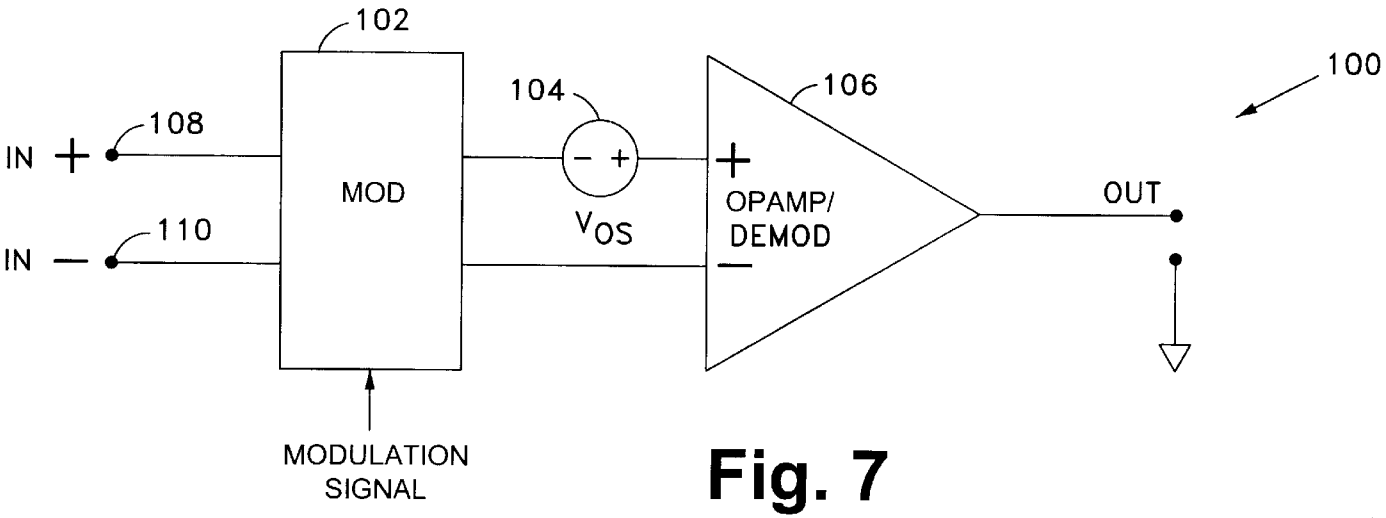
FIG. 7 is a block diagram illustrating a single-ended chopper amplifier architecture in accordance with one embodiment of the present invention.

FIG. 7 is a block diagram illustrating a single-ended chopper amplifier 100 in accordance with an embodiment of the present invention. As shown, the chopper amplifier 100 includes: a modulator 102, an offset voltage 104, and a single-ended, integrated operational amplifier/demodulator 106. The modulator 102 is similar to the modulators described previously (i.e., it modulates the voltage signal between two input nodes 108, 110 using a high frequency modulation signal). However, instead of using a separate demodulator unit to demodulate the output signal of the operational amplifier, the chopper amplifier 100 incorporates the demodulation functionality into the circuitry of the operational amplifier. In addition, the chopper amplifier 100 is configured to generate a single-ended output voltage (OUT). Thus, the chopper amplifier 100 does not require CMFB circuitry nor does it incur the other costs typically associated with fully differential amplifier architectures. The chopper amplifier 100 is capable of implementation in a relatively compact form (i.e., consuming less space on a semiconductor chip than a fully differential circuit), while maintaining a desired level of chopper performance. In one application, the chopper amplifier architecture of FIG. 7 is used to provide chopper stabilization within a bandgap reference circuit, as described hereinbefore (e.g., it can be used within bandgap reference circuit 60 of FIG. 4). The chopper amplifier 100 can also be used in many other applications requiring high performance chopper amplification including, for example, instrumentation amplifiers, analog-to-digital converters (ADC), filters, and others.

Figure 8:
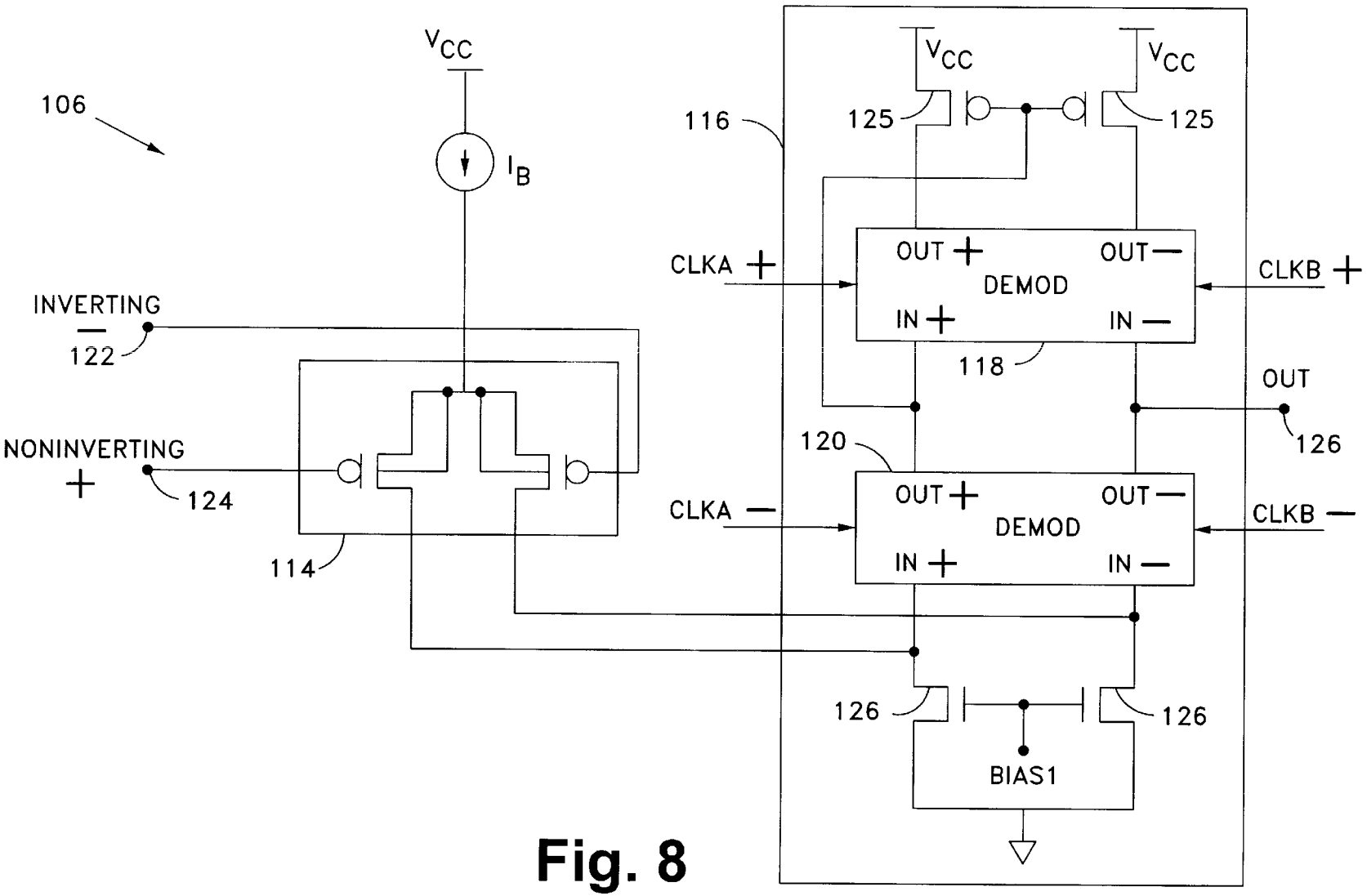
FIG. 8 is a schematic diagram illustrating an integrated operational amplifier/demodulator circuit having a single-ended output in accordance with an embodiment of the present invention.

FIG. 8 is a schematic diagram illustrating an integrated operational amplifier/demodulator 106 in accordance with an embodiment of the present invention. The integrated operational amplifier/demodulator 106 follows the general architecture of the well known single-ended, folded cascode operational amplifier. That is, the integrated operational amplifier/demodulator 106 includes an input amplification stage 114 including a common-source PMOS input pair (NMOS arrangements are also possible) followed by a folded cascode output amplification stage 116 that generates a single-ended output signal (OUT). However, unlike a conventional folded cascode operational amplifier, a pair of output demodulators 118, 120 are included within the cascode output stage 116 in place of the normal transistor arrangement. In this manner, the cascode output stage 116 operates as both an amplification stage to boost the level of the signal and a demodulation unit to demodulate the signal. Two demodulators are provided to handle both PMOS current source and NMOS current sink conditions.

That is, the first demodulator 118 is operative for cancelling offset and noise components generated within the PMOS current mirror pair 125 located above the first demodulator 118 and the second demodulator 120 is operative for cancelling offset and noise components of the NMOS current mirror pair 126 located below the second demodulator 120. In the illustrated embodiment, the first and second demodulators 118, 120 each receive two clock signals (CLKA, CLKB) that act in concert as the demodulation signal for the unit.

During operation, a modulated input signal is received at the inverting and non-inverting inputs 122, 124 of the operational amplifier/demodulator 106. The input signal is amplified by the input amplification stage 114 and then delivered to the folded cascode output stage 116. The folded cascode output stage 116 provides further amplification to the signal in a manner similar to the output stage of a convention single-ended folded cascode output stage. In addition, the signal is demodulated by the action of the two clocked demodulators 118, 120. A single-ended demodulated output signal (OUT) is generated at an output terminal 126 of the folded cascode output stage 116. As described above, because a single-ended output is produced, there is no need for a CMFB circuit at the amplifier output.

Figure 9:
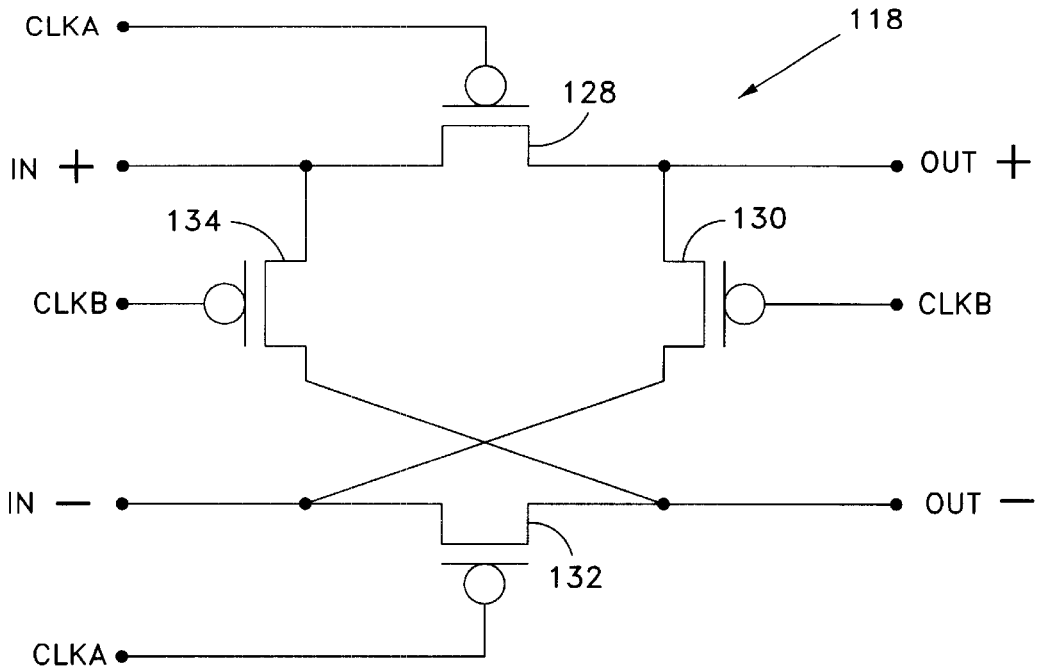
FIG. 9 is a schematic diagram illustrating the circuit structure of a first demodulator within the integrated operational amplifier/demodulator circuit of FIG. 8 in accordance with an embodiment of the present invention.

FIG. 9 is a schematic diagram illustrating the internal circuit structure of the first demodulator 118 within the folded cascode output stage 116 of FIG. 8 in one embodiment of the present invention. As shown, the first demodulator 118 includes four clocked PMOS devices 128, 130, 132, 134 that are arranged in a circuit configuration that is similar to the multiplier circuit 80 of FIG. 5. The demodulator 118 includes two differential input nodes (IN+, IN−) to receive the signal to be demodulated and two differential output nodes (OUT+, OUT−) to output the demodulated signal. Two clock signals (CLKA, CLKB) are received by the first demodulator 118 and act as the demodulation signal of the unit. The CLKA and CLKB signals are non-overlapping clock signals that are related to the modulation signal used by the associated modulator in the chopper amplifier. Two of the PMOS devices (i.e., device 128 and device 132) receive the CLKA signal at their gate terminals and the other two PMOS devices (i.e., device 130 and device 134) receive the CLKB signal at their gate terminals. When the clock A signal is logic low, the IN+node is connected directly to the OUT+node through device 128 and the IN−node is connected directly to the OUT−node through device 132. When the clock B signal is logic low, the IN+node is connected directly to the OUT−node through device 134 and the IN−node is connected directly to the OUT+node through device 130. In this manner, all previously modulated signal components are demodulated. The second demodulator 120 in the folded cascode output stage 116 will typically include the same basic circuit structure as the first demodulator 118, except for the use of NMOS devices instead of PMOSdevices. Operation will be substantially the same.

Referring back to FIG. 7, in at least one embodiment of the present invention, the modulator 102 that modulates the input signal of the operational amplifier/demodulator 106 includes multiplication functionality, such as multiplier circuit 80 of FIG. 5. As discussed previously, the multiplier circuit 80 receives two clock signals (CLK1, CLK2) that act in concert as the modulation signal of the modulator. Because the multiplier circuit 80 is acting solely as a modulator (i.e., not as an amplifier), the CLK1 and CLK2 signals used by the multiplier circuit 80 will typically switch between the two power rails of the system (e.g., $V_{CC}$ and ground). In effect, these voltage values will switch the transistors within the multiplier circuit 80 between fully "on" and fully "off" states. In contrast to the multiplier circuit 80, the first and second demodulators 118, 120 of FIG. 8 each perform an amplification function in addition to a demodulation function. To achieve a desired gain in the output stage 116, the transistors within the demodulators 118, 120 (e.g., transistors 128,130, 132, and 134 in FIG. 9) need to switch between predetermined resistance values, rather than between fully on and fully off conditions. For this reason, the clock signals (CLKA, CLKB) used to control the switching devices within the demodulators 118, 120 will preferably switch between voltage values that differ from the system power rails. For example, with reference to FIG. 9, the CLKA signal will preferably use a low voltage value that is more than $V_{SS}$ (e.g., $0.7V_{CC}$) to avoid turning PMOS devices 128 and 132 fully on during the low voltage period. The particular voltage values will typically be determined during the design process based on, for example, the desired gain of the cascode output stage 116. The voltage values that are chosen should be adequate to keep the transistors within the demodulators 118, 120 in saturation during circuit operation. As can be appreciated, different high and/or low voltage values may be used for the first (PMOS) demodulator 118 than are used for the second (NMOS) demodulator 120.

Figure 11:
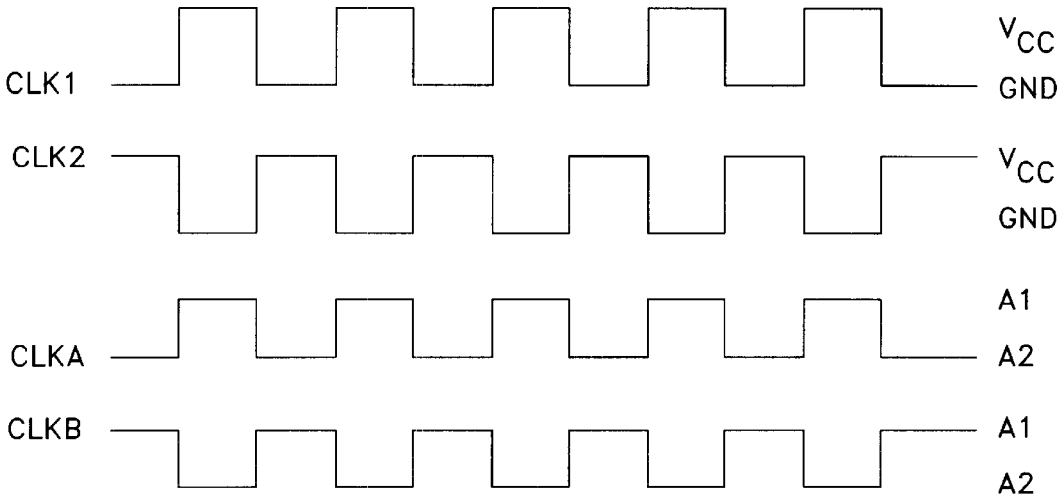
FIG. 11 is a timing diagram illustrating various clock signals that are used to perform modulation and demodulation functions in accordance with an embodiment of the present invention.
Figure 10:
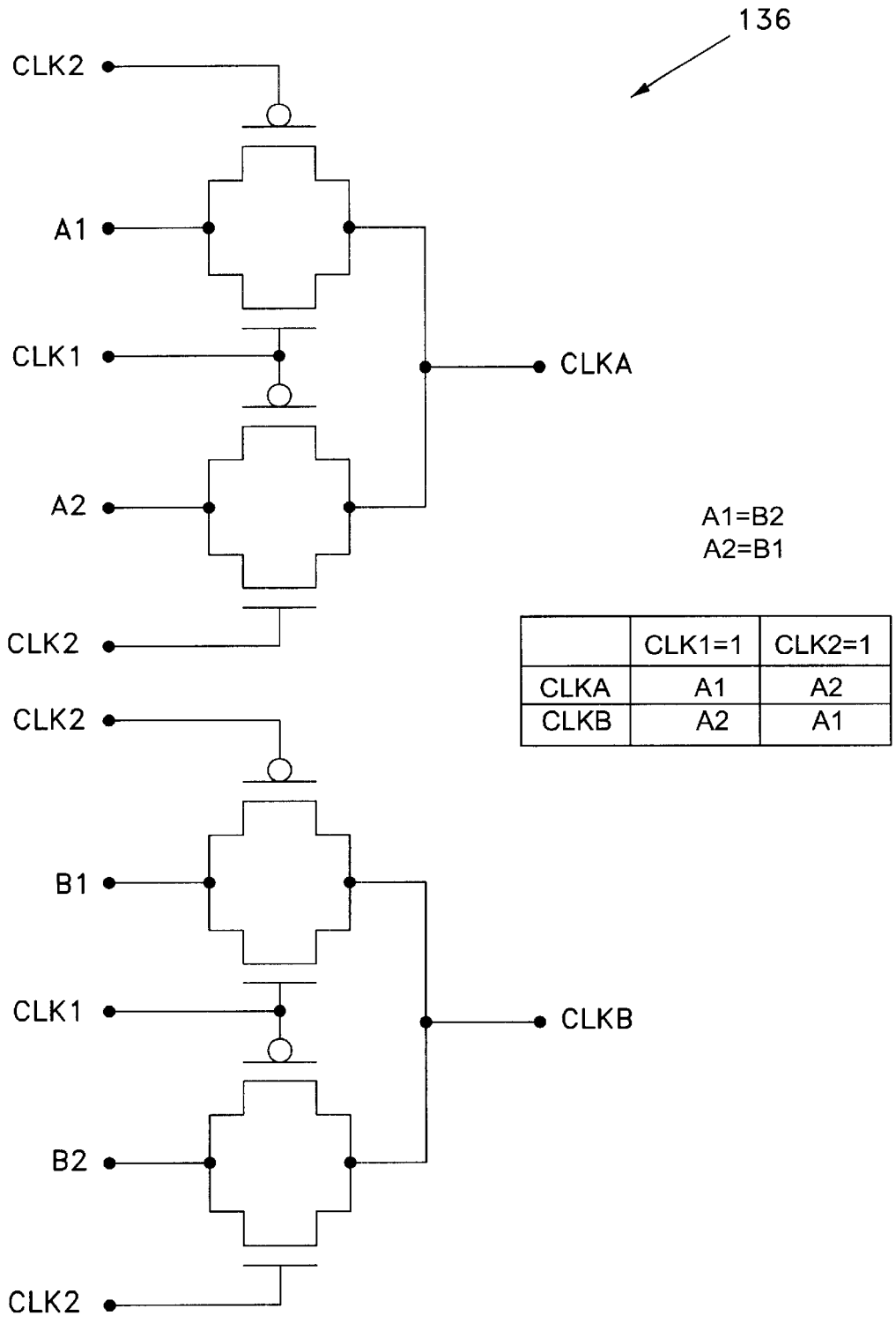
FIG. 10 is a schematic diagram illustrating a pair of multiplexer units that are used to generate demodulation clock signals in accordance with an embodiment of the present invention.

FIG. 10 is a schematic diagram illustrating a pair of multiplexer units 136 that are used in one embodiment of the present invention to generate the CLKA and CLKB signals used by the demodulators 118, 120. In one approach, a dedicated multiplexer pair 136 is provided for each demodulator 118, 120 (i.e., because different high and low voltage values may be required for each demodulator). The two multiplexer units 136 each includes a pair of CMOS switches to switch a corresponding output clock signal between predetermined high and low voltage values based on a pair of input clock signals (CLK1, CLK2). That is, the top multiplexer switches the CLKA signal between a voltage value of A1 and a voltage value of A2 and the bottom multiplexer switches the CLK B signal between a voltage value of B1 and a voltage value of B2, in response to the input clock signals. The A1, A2, B1, and B2 bias voltage values are generated elsewhere within the system (e.g., within bias circuitry). Depending on the bias signal level, NMOS or PMOS switches may be used instead of the CMOS switches shown in FIG. 10. In the illustrated embodiment, the A1 voltage value is equal to the B2 voltage value and the A2 voltage value is equal to the B1 voltage value. The input clock signals (CLK1, CLK2) are the same signals used to clock the associated modulator, as described above. FIG. 11 is a timing diagram illustrating the various clock signals used in one embodiment of the present invention.

Although the present invention has been described in conjunction with certain embodiments, it is to be understood that modifications and variations may be resorted to without departing from the spirit and scope of the invention as those skilled in the art readily understand. Such modifications and variations are considered to be within the purview and scope of the invention and the appended claims.

What is claimed is:

1. A bandgap reference circuit comprising:

a modulator to modulate an input signal;

an amplifier to amplify the modulated input signal;

a demodulator to demodulate an amplified version of the modulated input signal;

a closed feedback loop to couple an output of the demodulator to an input of the modulator; and a reference voltage output node to carry a reference voltage that is relatively insensitive to temperature change, said reference voltage being stabilized by the action of said modulator, said amplifier, said demodulator, and said closed feedback loop.

2. The bandgap reference circuit of claim 1, comprising:

a low pass filter having an output coupled to said reference voltage output node, said low pass filter to reject high frequency noise components before they reach said reference voltage output node.

3. The bandgap reference circuit of claim 2, wherein:

said low pass filter is located outside said closed feedback loop.

4. The bandgap reference circuit of claim 1, wherein:

said input signal is a differential voltage signal occurring between first and second input nodes.

5. The bandgap reference circuit of claim 4, wherein:

said first input node is coupled to a ground node through a first PN junction and said second input node is coupled to said ground node through a second PN junction, said second PN junction having a junction area that is significantly larger than that of said first PN junction.

6. The bandgap reference circuit of claim 4, comprising:

first, second, and third transistors having interconnected gate terminals, said interconnected gate terminals being connected to receive an output signal of said demodulator, said first transistor having a drain/source terminal coupled to said first input node, said second transistor having a drain/source terminal coupled to said second input node, and said third transistor having a drain/source terminal coupled to an input node of a low pass filter.

7. The bandgap reference circuit of claim 1, wherein:

said amplifier and said demodulator share at least one common transistor.

8. The bandgap reference circuit of claim 1, wherein:

said demodulator is implemented as part of said amplifier.

9. The bandgap reference circuit of claim 8, wherein:

said demodulator uses a demodulation signal to demodulate the amplified version of the modulated input signal, said demodulation signal switching between a nominal high voltage value and a nominal low voltage value, wherein said nominal high voltage value and said nominal low voltage value are selected to achieve a predetermined gain within said amplifier.

10. The bandgap reference circuit of claim 1, wherein:

said amplifier includes a single-ended operational amplifier.

11. The bandgap reference circuit of claim 1, wherein:

said amplifier includes a single-ended, folded cascode type operational amplifier, said single-ended, folded cascode type operational amplifier including an input amplification stage and an output amplification stage, said output amplification stage including said demodulator.

12. A bandgap reference circuit comprising:

means for modulating a differential input signal, using a modulation signal, to generate a modulated input signal;

means for amplifying the modulated input signal;

means for demodulating an amplified version of said modulated input signal using a demodulation signal;

means for providing feedback between an output of said means for demodulating and an input of said means for modulating; and means for outputting a reference voltage that is relatively insensitive to changes in temperature, said reference voltage being stabilized by the action of said means for modulating, said means for amplifying, said means for demodulating, and said means for providing feedback.

13. The bandgap reference circuit of claim 12, comprising:

means for rejecting high frequency noise components output by said means for demodulating, said means for rejecting having an output that is connected to said means for outputting a reference voltage.

14. The bandgap reference circuit of claim 13, wherein:

said means for providing feedback includes a closed feedback loop, wherein said means for rejecting high frequency noise components is located outside said closed feedback loop.

15. The bandgap reference circuit of claim 12, wherein:

said means for amplifying and said means for demodulating include a single-ended, folded cascode type operational amplifier.

16. A bandgap reference circuit comprising:

a first input node coupled to a ground node through a first PN junction;

a second input node coupled to said ground node through a second PN junction, said second PN junction having a junction area that is greater than that of said first PN junction;

a modulator to modulate a voltage signal occurring between said first input node and said second input node, said modulator outputting a modulated signal;

an amplifier to amplify the modulated signal;

a demodulator to demodulate an amplified version of the modulated input signal; and first, second, and third transistors having interconnected gate terminals, said interconnected gate terminals being connected to receive an output signal of said demodulator, said first transistor having a drain/source terminal coupled to said first input node, said second transistor having a drain/source terminal coupled to the second input node, and said third transistor having a drain/source terminal coupled to an input node of a low pass filter.

17. The bandgap reference circuit of claim 16, comprising:

a reference voltage output node coupled to an output of said low pass filter to carry a reference voltage that is relatively insensitive to temperature change.

18. The bandgap reference circuit of claim 16, wherein:

said first, second, and third transistors form a ratioed current mirror within the bandgap reference circuit.

19. The bandgap reference circuit of claim 16, wherein:

said first transistor is part of a closed feedback loop of said amplifier and said third transistor is outside said closed feedback loop.

20. A bandgap reference circuit comprising:

a modulator to modulate an input signal;

an integrated amplifier/demodulator to amplify and demodulate the modulated input signal, said integrated amplifier/demodulator having a single ended output;

a closed feedback loop to couple an output signal of the integrated amplifier/demodulator to an input of the modulator; and a reference voltage output node to carry a reference voltage that is relatively insensitive to temperature change, said reference voltage being stabilized by the action of said modulator, said integrated amplifier/demodulator, and said closed feedback loop.

21. The bandgap reference circuit of claim 20, wherein:

said integrated amplifier/demodulator includes at least one transistor that performs both a signal amplification function and a signal demodulation function.

22. The bandgap reference circuit of claim 20, wherein:

said integrated amplifier/demodulator includes a single-ended operational amplifier.

23. The bandgap reference circuit of claim 20, wherein:

said integrated amplifier/demodulator includes a single-ended operational amplifier having a folded cascode type configuration, said folded cascode type configuration including an input amplification stage and an output amplification stage.

24. The bandgap reference circuit of claim 23, wherein:

said output amplification stage includes at least one demodulator unit for performing signal demodulation in response to a demodulation signal.

25. The bandgap reference circuit of claim 24, wherein:

said demodulation signal switches between first and second nominal voltage values, wherein said first and second nominal voltage values are selected to achieve a predetermined gain within said output amplification stage.

26. The bandgap reference circuit of claim 24, wherein:

said output amplification stage includes first and second demodulator units, said first demodulator unit being connected to a PMOS current mirror pair and said second demodulator unit being connected to an NMOS current mirror pair.

27. The bandgap reference circuit of claim 26, wherein:

said first demodulator unit includes a plurality of PMOS devices and said second demodulator unit includes a plurality of NMOS devices.

* * * * *